United States Patent [19]

Tierney et al.

[11] 4,026,334

[45] May 31, 1977

[54] METHOD OF CONTINUOUSLY PROCESSING METAL CORD

[75] Inventors: Paul A. Tierney, Raleigh; Robert P. Bell, Cary, both of N.C.

[73] Assignee: Monsanto Company, St. Louis, Mo.

[22] Filed: Oct. 10, 1975

[21] Appl. No.: 621,323

[52] U.S. Cl. ..... 140/112; 140/147; 219/57

[51] Int. Cl.[2] ..... B21F 1/02

[58] Field of Search ..... 140/111, 112, 147; 29/33 B; 228/155, 158; 219/57, 154; 72/199, 365, 366; 242/128, 78.6, 80

[56] References Cited

UNITED STATES PATENTS

| | | | |
|---|---|---|---|
| 1,787,301 | 12/1930 | Bailey | 242/128 |
| 3,584,853 | 6/1971 | Munson | 266/3 |
| 3,605,469 | 9/1971 | Queralto | 72/183 |
| 3,835,681 | 9/1974 | Shumaker | 29/33 |

*Primary Examiner*—Lowell A. Larson
*Attorney, Agent, or Firm*—Donald J. Fitzpatrick

[57] ABSTRACT

A method of continuously processing metal cord is disclosed. The method comprises the steps of twisting a plurality of filaments together to form a cord, collecting the cord on a spool in such a manner that transfer segments are provided; straightening the transfer segments; welding the transfer segment of a first spool to the transfer segment of a second spool; passing the cord continuously through a mechanical straightener and reducing the force exerted by the straightener on that section of the cord containing the welded portion.

2 Claims, 2 Drawing Figures

METHOD OF CONTINUOUSLY PROCESSING METAL CORD

BACKGROUND OF THE INVENTION

1. Field of the Invention

This invention relates to a method for processing metal cord and more particularly to a method for processing cord containing welds continuously through a mechanical straightener without breakage.

2. DESCRIPTION OF THE PRIOR ART

In order for various industrial processes to be economical they must be essentially continuous in nature. That is, the number of steps must be minimal to maintain a high rate of production coupled with a minimum amount of handling or stoppages in the production cycle.

One such industrial process is the treatment of steel cord for reinforcing rubber composites, such as hoses, conveyor belts and pneumatic tires. In processing steel cord a number of filaments are twisted together to form a cord or strand on a strander, double twist buncher or ring twister. After the strand or cord is formed, certain other steps must be performed to produce a usable product. For example, the twisted product must be cleaned and then coated with an adhesive material to insure adhesion within the rubber composite. Each time the product is treated, it is generally unwound and then rewound. It is readily apparent that for this process, consisting of numerous steps, to be economical it must be continuous. That is, to minimize handling and interruptions each package or spool of cord must be fastened in some way to the preceding package or spool. The spools can be knotted together, but the generally accepted manner is by welding the head end of one spool to the tail end of another spool.

Welding, however, presents certain problems. The consumers of adhesive coated steel cord or strand have established stringent quality requirements. One very important requirement is straightness. That is, when the product is unwound from its package it must lie straight without any twist or curliness. For instance, a 20 foot (6.08meter) length of cord must not deviate more than 3 inches (7.62 cm) from a straight line. Assembling cords and strands from filaments induces stresses that cause the product to take helical configuration. The tendency to take this shape can be eliminated and a straight cord can be obtained by passing it through a mechanical straightener or heat treating as disclosed in copending U.S. Pat. Application Ser. No. 229,515, filed on Feb. 25, 1972 and assigned to the assignee of this invention.

To insure a continuous feeding of cord on succeeding spools must be fastened one-to-another. As the supply of cord on one spool is exhausted cord must immediately start feeding from another spool. It has been found that welding the cords together is the best approach to attain continuous feeding. A proper weld does not appreciably change the cross-section of the cord as other techniques such as tying the ends together and is sufficiently strong to hold the two cord sections together during processing. Welding can be performed before or after the cord or strand has been straightened. Regardless of when the product is welded, that is, before or after straightening each approach presents certain problems.

If the cord is welded after straightening an accumulator capable of accumulating a sufficient amount of cord to insure continuity of processing is required. For example, if the cord is traveling at a line speed of 450 –500 fpm (135 –150 mpm) and it takes 2 minutes to complete welding and post weld heat treating an accumulator is needed capable of storing 900 to 1,000 feet (274 –305 meters) of cord. Employing or installing an accumulator increases operational and maintenance costs as well as capital expenses.

Welding prior to straightening is another alternative. The cord package contains a head segment and tail segment, two portions of the cord length easily identified from the remainder of the package. The tail segment of a first spool can be welded to the head segment of a second spool and then continuously passed to a straightener. This insures a continuous process without the use of an accumulator. It has been found that continuously passing cord containing welds through a mechanical straightener is not commercially reliable. The weld must be metallurgically sound, ductile enough to withstand bending stresses in the mechanical straightener yet strong enough to join the spool ends together. To consistently produce welds of this nature is extremely difficult on a production basis. For a reliable operation with a minimum amount of down time nearly 100 percent weld performance or no weld breaks is required. This performance has not yet been attained by passing welds through a mechanical straightener.

This invention provides for a continuous operation wherein weld breakage is not incurred. The resultant product is straight and the use of an accumulator is not required.

SUMMARY OF THE INVENTION

The present invention relates to a method of continuously processing metal cord. Cord is prepared by twisting together a plurality of filaments and then collecting it on a spool in such a manner that the head and tail segments of the collected spool are accessible for welding to like segments of other spools. After welding the cord is passed through a mechanical straightener and then coated with an adhesive. A critical feature of this invention is the provision for reducing the force exerted by the straightener on the section of the cord containing the welded portion.

The method of the present invention allows spools of twisted cord to be processed in a continuous manner into a product that is essentially straight and provided with an adhesive coating. The invention comprises the following steps:

a. a twisting together a plurality of wires together to form a cord;

b. collecting the cord on a spool in such a manner that transfer segments are provided;

c. straightening the transfer segments;

d. welding the transfer segment of a first spool to the transfer segment of a second spool;

e. passing the cord continuously through a mechanical straightener; and f. reducing the force exerted by the straightener on that section of the cord containing the welded portion.

It is therefore an object of this invention to provide a method for processing metal cord in a continuous manner by welding a tail segment of a first spool to a head segment of a second spool and repeating the welding step each time all the cord on a spool has passed on to the straightener.

It is another object of this invention to pass cord containing welds through a mechanical straightener.

A further object of this invention is to reduce the force exerted in a mechanical straightener on that section of the cord containing the welded portion.

A still further object of this invention is to provide a straight cord.

DETAILED DESCRIPTION OF THE PREFERRED EMBODIMENT

The present invention provides a method for continuously processing metal cord. The terms strand and cord are herein used in the conventional sense in that a strand means a plurality of wires combines about a common axis and a cord connotes a plurality of strands combined about a common axis. These terms may be used interchangeably in this specification.

The wire used in this invention is generally a carbon steel having minor alloying elements. The invention is not limited to carbon steels however, and other materials such as stainless steels and non-ferrous alloys are within the scope of this invention.

The actual twisting of strand or cord can be done using standard equipment such as double twist bunchers, stranders of ring twisters. A plurality of wires are paid off creels to the twisting apparatus, wherein a desired level of twist is imparted to the strand. A plurality of strands may similarly be twisted in the same or opposite direction to form a cord in a classical S/Z or Z/Z configuration.

After the cording or stranding has been accomplished, the product is collected on a take-up spool. During take-up a tail segment, hereinafter referred to as the transfer tail, and a head segment are provided at the ends of the take-up spool. As a result of the stresses imparted on the wires during the twisting operation the cord or strand is extremely curly and when unraveled from the spool will not lie in a straight line.

Figure 1:
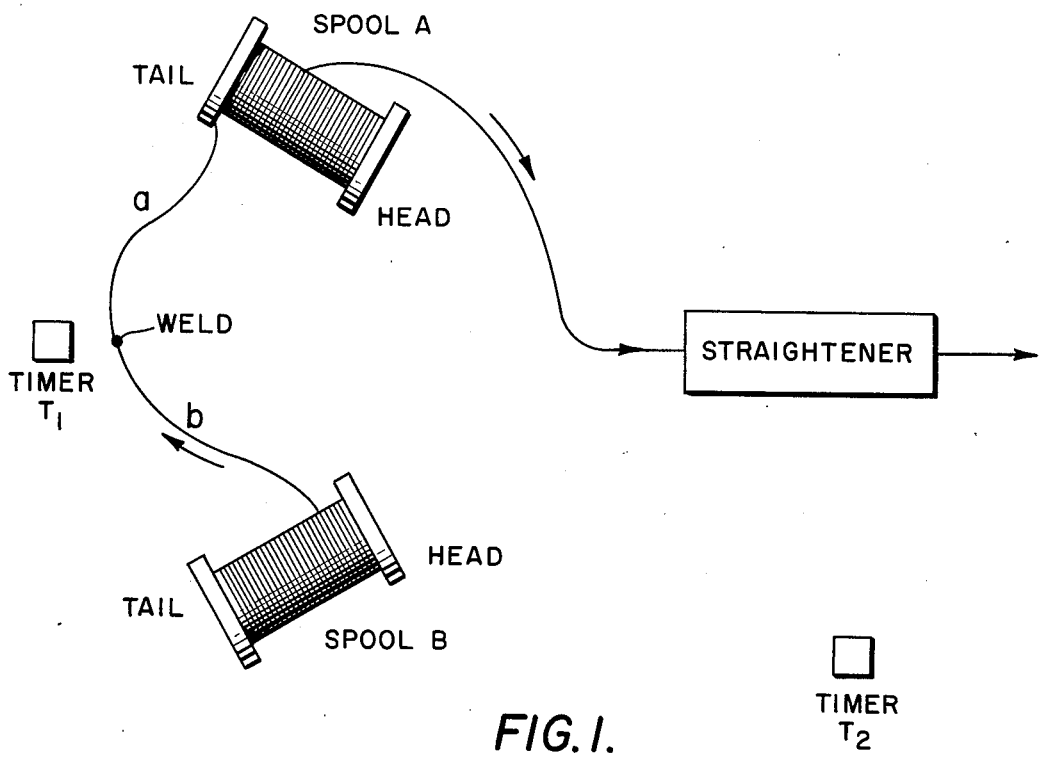
FIG. 1 is a schematic showing the positioning of equipment and spools of cord.

A better understanding of this invention can be obtained by reference to the accompanying figures. As shown in FIG. 1, the cord contained on spool A is being fed into a mechanical straightener. For simplicity, pulleys, drive stands and tension control means are not shown. When all of the cord on spool A has passed through the straightener, the continuity of the process will not change because the cord on spool B will immediately start feeding into the straightener. This is accomplished in the following manner. The tail segment *a* or transfer portion of spool A is unraveled a predetermined distance from the spool and mechanically straightened by passing it through an off-line secondary straightener (not shown) and then clamped into a welding jig (not shown). The head segment *b* or transfer portion of spool B is unraveled a predetermined distance from the spool, straightened in a similar manner in the off-line straightener, clamped into the welding jig and then the segments are welded together. The weld is then heat treated and tested for strength.

As soon as a transfer is to be made, that is, when all of the cord on spool A has been used up, and the cord on spool B is ready to be fed into the straightener, timers T1 and T2 are activated. Timer T1 measures the time from transfer to the entry of the cord segment at the staightener. When the segments containing the welds reach the straightener, timer T2 momentarily causes the force exerted by the straightener on the cord to be reduced thereby permitting segments *a* and *b* to pass on through the straightener. After segment b has passed, timer T2 activates the straightener and force is one again exerted onto the cord.

Figure 2:
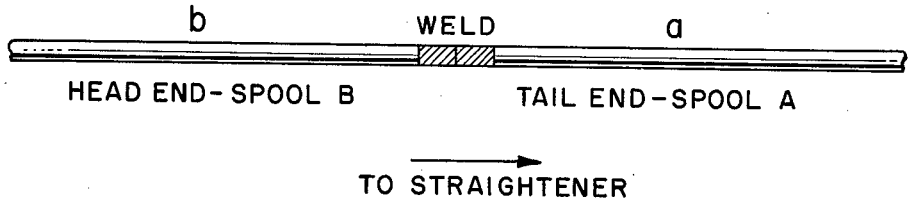
FIG. 2 is a schematic showing a cord transfer portion.

FIG. 2 shows tail segment *a* and head segment *b* with a weld in the approximate desired location. It is desirable to have the weld at about the mid-point of segments *a* and *b*. This entire portion was straightened off-line with the exception of the small portion containing the weld. When segment *a* enters the straightener timer T2 automatically opens the spacing between the straightening rolls thereby reducing the pressure on the cord and permitting the less ductile weld to pass through the straightener. As soon as segment *b* has passed through, the timer is activated a second time and force is reasserted on the cord. The operation of timers T1 and T2 and the velocity of the cord are carefully balanced to make sure that the portion containing the weld passes through the straightener at the precise time when all straightening forces are relaxed.

After the cord on spool A is used up and spool B starts to feed the straightener, the empty spool is removed and a full spool is placed onto the creel. The tail segment of spool B is welded to the head segment of the new spool and a continuous feed of material to the straightener is assured.

Processing metal cord according to this invention has shown that more that 99 percent of the welds successfully passed through the straightener. Prior to this invention straightening after welding resulted in a weld breakage rate of approximately 70 percent. This causes considerable loss of production and a very uneconomical process.

SPECIFIC EXAMPLE

A five line system employing the method of this invention was operated on a routine five-day basis. Each line had a mechanical straightener and was ring-twisted to form a 1 × 5 × 0.010 inch steel cord of a nominal C1070 composition.

During this 5 day period 268 transfers were made and a total of 4,800 kg of cord was processed. After the cord was straightened it was passed through an adhesive coating bath and repackaged on take-up bobbins. Weld reliability during this period was 99.6%

Although the present invention has been described and illustrated in connection with certain preferred embodiments, it is to be understood that modifications and variations may be resorted to without departing from the spirit of the invention, as those skilled in this art will readily understand. Such modidications and variations are considered to be within the scope of the present invention as defined by the appended claims.

We claim:

1. In a method of continuously processing spools of metal cord, including:
   a. twisting a plurality of filaments together to form cords;
   b. collecting said cords on spools in such a manner that transfer segments are provided; the improvement comprising:
   c. straightening said transfer segments;
   d. welding the transfer segment of a first spool to the transfer segment of a second spool;
   e. passing the cord continuously through a mechanical straightener; and
   f. reducing the force exerted by the mechanical straightener on the transfer segments of the cord containing the welded portion.

2. The method of claim 1 wherein said filaments are steel.

* * * * *